US008678792B2

(12) United States Patent
Mazur et al.

(10) Patent No.: US 8,678,792 B2
(45) **Date of Patent: *Mar. 25, 2014**

(54) PULSATILE ROTARY VENTRICULAR PUMP

(75) Inventors: Daniel E. Mazur, Ann Arbor, MI (US); Scott I. Merz, Ann Arbor, MI (US); Kathryn R. Osterholzer, Dexter, MI (US)

(73) Assignee: Michigan Critical Care Consultants, Inc., Ann Arbor, MI (US)

( * ) Notice: Subject to any disclaimer, the term of this patent is extended or adjusted under 35 U.S.C. 154(b) by 133 days.

This patent is subject to a terminal disclaimer.

(21) Appl. No.: 13/449,234

(22) Filed: Apr. 17, 2012

(65) Prior Publication Data

US 2013/0101452 A1 Apr. 25, 2013

Related U.S. Application Data

(63) Continuation of application No. 12/095,733, filed as application No. PCT/US2006/046076 on Dec. 1, 2006, now Pat. No. 8,162,634.

(60) Provisional application No. 60/741,526, filed on Dec. 1, 2005.

(51) Int. Cl.

| | |
|---|---|
| ***F04B 45/06*** | (2006.01) |
| ***A61M 1/00*** | (2006.01) |
| ***F04B 43/12*** | (2006.01) |

(52) U.S. Cl.

CPC ..... *F04B 43/1215* (2013.01)
USPC ..... 417/477.12; 417/477.13; 604/153

(58) Field of Classification Search

CPC ..... F04B 43/1215
USPC ..... 417/477.12, 477.13; 604/153
See application file for complete search history.

(56) References Cited

U.S. PATENT DOCUMENTS

| | | | |
|---|---|---|---|
| 2,123,781 | A | 7/1938 | Huber |
| 3,295,556 | A | 1/1967 | Gertsma et al. |
| 3,403,631 | A | 10/1968 | Tangeman |
| 3,756,752 | A | 9/1973 | Stenner |
| 4,066,238 | A | 1/1978 | Clarke |
| 4,087,301 | A | 5/1978 | Steadman |
| 4,102,612 | A | 7/1978 | Ritter |

(Continued)

FOREIGN PATENT DOCUMENTS

| | | | |
|---|---|---|---|
| EP | 0087682 | A | 9/1983 |
| EP | 0089122 | A2 | 9/1983 |

(Continued)

*Primary Examiner* — Charles Freay
(74) *Attorney, Agent, or Firm* — Jeffrey Schox

(57) ABSTRACT

A roller pump conduit defining a pump chamber is provided. The roller pump conduit includes a roller contact portion having a fill region and a delivery region. The fill region has a first taper configured to determine volume delivery per revolution of a roller head. The delivery region has a pressure region having a second taper and a discharge region having a third taper. The third taper has a lesser degree of taper than the second taper. The delivery region is configured to produce a pulsatile flow out of the conduit. Furthermore, a roller pump having a roller pump conduit is provided. The roller pump conduit of the roller pump has a fill region and a delivery region, the fill region having a first taper, and the delivery region having a second and third taper, wherein the third taper has lesser degree of taper than the second taper.

25 Claims, 2 Drawing Sheets

(56) References Cited

U.S. PATENT DOCUMENTS

| | | | | |
|---|---|---|---|---|
| 4,108,575 | A | 8/1978 | Schal | |
| 4,131,399 | A | 12/1978 | Calvet | |
| 4,211,519 | A | 7/1980 | Hogan | |
| 4,275,761 | A | 6/1981 | Waldhauser | |
| 4,445,500 | A | 5/1984 | Osterholm | |
| 4,445,886 | A | 5/1984 | Osterholm | |
| 4,473,342 | A | 9/1984 | Iles | |
| 4,478,661 | A | 10/1984 | Lewis | |
| 4,515,535 | A | 5/1985 | D Silva | |
| 4,515,589 | A | 5/1985 | Austin et al. | |
| 4,540,350 | A | 9/1985 | Streicher | |
| 4,631,008 | A | 12/1986 | Stenner | |
| 4,650,471 | A | 3/1987 | Tamari | |
| 4,686,085 | A | 8/1987 | Osterholm | |
| 4,734,184 | A | 3/1988 | Burleigh et al. | |
| 4,767,289 | A | 8/1988 | Parrott et al. | |
| 4,786,394 | A | 11/1988 | Enzer et al. | |
| 4,844,871 | A | 7/1989 | Polaschegg | |
| 4,871,439 | A | 10/1989 | Enzer et al. | |
| 4,954,055 | A * | 9/1990 | Raible et al. | 417/477.5 |
| 5,067,879 | A | 11/1991 | Carpenter | |
| 5,088,522 | A | 2/1992 | Rath et al. | |
| 5,195,960 | A | 3/1993 | Hossain et al. | |
| 5,215,450 | A | 6/1993 | Tamari | |
| 5,215,501 | A | 6/1993 | Ushikoshi | |
| 5,222,880 | A | 6/1993 | Montoya et al. | |
| 5,281,112 | A | 1/1994 | Montoya et al. | |
| 5,282,783 | A | 2/1994 | Lindsay | |
| 5,286,262 | A | 2/1994 | Herweck et al. | |
| 5,342,182 | A | 8/1994 | Montoya et al. | |
| 5,380,314 | A | 1/1995 | Herweck et al. | |
| 5,423,661 | A | 6/1995 | Gabeler et al. | |
| 5,486,099 | A | 1/1996 | Montoya | |
| 5,512,042 | A | 4/1996 | Montoya et al. | |
| 5,599,175 | A | 2/1997 | Tojo et al. | |
| 5,614,378 | A | 3/1997 | Yang et al. | |
| 5,658,136 | A | 8/1997 | Mendler | |
| 5,711,753 | A | 1/1998 | Pacella et al. | |
| 6,047,108 | A | 4/2000 | Sword et al. | |
| 6,129,699 | A | 10/2000 | Haight et al. | |
| 8,162,634 | B2 * | 4/2012 | Mazur et al. | 417/477.12 |
| 8,226,591 | B2 | 7/2012 | Mazur | |
| 2005/0095171 | A1 | 5/2005 | Fressinet et al. | |
| 2006/0233648 | A1 | 10/2006 | Liu et al. | |
| 2008/0183287 | A1 | 7/2008 | Ayre | |
| 2008/0200878 | A1 | 8/2008 | Davis et al. | |
| 2008/0319544 | A1 | 12/2008 | Yaegashi | |
| 2010/0036486 | A1 | 2/2010 | Mazur | |
| 2010/0150759 | A1 | 6/2010 | Mazur et al. | |

FOREIGN PATENT DOCUMENTS

| | | | |
|---|---|---|---|
| EP | 0376298 | A1 | 7/1990 |
| JP | 07506882 | | 7/1995 |
| JP | 10511161 | A | 10/1998 |
| WO | 9403216 | A1 | 2/1994 |
| WO | 2005042066 | A | 5/2005 |
| WO | 2007064927 | A2 | 6/2007 |

* cited by examiner

PULSATILE ROTARY VENTRICULAR PUMP

CROSS-REFERENCE TO RELATED APPLICATIONS

This application is a continuation of and claims the benefit of U.S. patent application Ser. No. 12/095,733 filed Oct. 20, 2008, which is the U.S. National Stage entry of International Application No. PCT/US06/46076 filed Dec. 1, 2006, which claims the benefit of U.S. Provisional Application No. 60/741,526, filed on Dec. 1, 2005, the complete disclosures of which are herein incorporated by reference.

FIELD OF THE INVENTION

The present invention relates to cardiovascular pumps, and more particularly, to cardiovascular roller pumps that create a pulsatile flow profile.

BACKGROUND

The American Heart Association indicates that 30,000 cardiopulmonary bypass (CPB) surgeries were done on patients of ages less than 15 years in the USA in 2002. Of these cases, 18,000 were specifically for the repair of congenital defects of the heart. Over the past decade, mortality rates associated with pediatric cardiopulmonary bypass procedures have been significantly reduced, yet morbidity remains a major clinical problem with patients suffering cerebral, myocardial, or renal dysfunction following CPB. Factors associated with extracorporeal circuit (ECC) technology, such as non-pulsatile perfusion, hemodilution, and acute injury due to mishap have been implicated in patient morbidity. Despite this evidence, innovation has been slow in coming. Roller pumps that were first used in perfusion studies in 1935 are still relied on in 98% of centers performing pediatric CPB today.

One visible side-effect of CPB in infants and children is systemic accumulation of edema fluid. In a prospective study of 100 neonates undergoing corrective cardiac surgery employing approximately 2 hours of CPB, the average fluid accumulation was greater than 600 ml. Much of this phenomenon is related to the hemodilution and foreign surface exposure of the blood loop. A typical infant of 3.5 kg weight has an estimated blood volume of 280 ml, and the extracorporeal loop with the venous reservoir, oxygenator, blood filter, and tubing can easily reach 700-800 ml of prime, resulting in a dilution factor of 2.5:1 to 3:1. Hemodilution in infants can far exceed that seen in adult patients, where 25% to 33% dilution rates are typical. Hemodilution results in lower hematocrit with associated reduction of oxygen delivery capacity, and is associated with a higher transfusion rate and increased use of all blood products with concomitant infection risk.

Deep hypothermic circulatory arrest is commonly used in the repair of congenital defects of the heart. Cessation of blood flow to the collateral circulation allows the surgeon to properly visualize the surgical field, while hypothermia reduces metabolism providing cellular protection despite lack of oxygen delivery. In recent practice, deep hypothermic circulatory arrest is conducted with intermittent periods of very tow blood flow in the range of 10 to 20 cc/kg/min or "trickle flow". It is commonly felt that this amount of flow can be provided without compromising the conduct of the surgical repairs, and will serve to preserve brain high energy phosphate concentrations and intracellular pH (20). In order to meet these requirements the arterial pump must be capable of maintaining flow accuracy over a broad range of flow rates and temperature from 10 cc/kg at 15° C., to 150 cc/kg at 37° C.

Centrifugal pumps are simply not practical in providing for extreme low flow rates due to excessive impeller speeds and resulting blood damage and in fact are relied on only in 2% of centers conducting pediatric heart surgery. Occlusive roller pumps are currently used; however, they are far from optimal in their use at low flow rates.

Generally, roller pumps rely on a roller pressing against a piece of tubing backed by a rigid raceway. In order to fully occlude the circular tubing for use in very low flow conditions, excessive roller forces are needed to squeeze the tubing between the roller and raceway. This significantly increases stress and wear on the tubing, potentially causing leaks or ruptures. A review of the Manufacturer and User Facility Device Experience Database (MAUDE) reports supports the conclusion that tubing leaks and rupture are common events with potentially injurious results.

Traditionally, roller pumps provided no inherent means of preventing draining of the venous reservoir, and if left unattended, would drain the reservoir and continue to pump air to the patient until rotation was halted. A minimum "safety volume" of blood had to be maintained in the reservoir when using a roller pump so as to provide sufficient time for the perfusionist to react to sudden interruptions of venous return flow before the reservoir was drained. For example, at a flow rate of 1.5 l/min, using the known state-of-the-art Terumo Capiox reservoir, 300 ml of reservoir volume would provide less than 12 seconds of response time.

This has prompted the use of reservoir level detectors and air detectors with pump shut off interconnections. 79.2% of centers conducting pediatric extracorporeal circulation (ECC) utilize reservoir level detectors, and 87.5% of these centers utilize air bubble detectors. However, despite their presence, these safety devices may fail to protect due to device failures and human errors. In practice, a typical circuit volume for a small infant could range from 600-800 ml.

In order to provide a safe operational venous reservoir level for use with roller pumps, 200 additional ml are typically added to the circuit, which is usually whole blood or packed red blood cells. This safety volume is highly variable amongst practitioners and could be minimized if a self-limiting safety system was designed into the pump. If this 200 ml volume could be eliminated, the savings in both hemodilution side-effects and risks to additional blood product transfusion would be of significant benefit.

Proper setting of the degree to which a roller pump occludes the tubing is also critical. If there is too little occlusion, the pump fails to create sufficient flow. Over occlusion creates excessive stress in the tubing which can lead to splitting with subsequent blood loss and air introduction to the arterial circulation. Split tubing continues to be a common problem with traditional roller pumps.

Current peristaltic pump technology typically operates with two pump rollers and a 180 degree arc over which the pump tubing is occluded by the rollers and a stator. In this design, fluid enters the pump tubing from the venous reservoir under low pressure head conditions, typically 50 mmHg or less. The purpose of the roller pump is to shuttle this fluid from the inlet to the outlet and force it to flow through the tubing circuit. Typically in heart surgery this involves moving blood from a low pressure inlet to a high pressure outlet. As the roller head (rotor) turns, a roller contacts and advances along the tubing filling it with tow pressure blood. At approximately the 180 degree point of the stator arc, a second roller contacts the tubing and isolates the fluid between the rollers still at the low inlet pressure. This situation lasts only briefly as the first roller departs from the tubing exposing the low pressure isolated fluid to the high pressure outlet fluid. This causes an equilibration of pressure between the fluid volumes and is associated with a momentary drop in pressure in the outlet. As the second roller continues to advance it drives the fluid forward reestablishing pressure within the outlet tubing.

Another style of roller pump, without a stator, utilizes a roller head (rotor) with three rollers and a conduit having an occlusive portion. The conduit extends around the rollers. The occlusive portion remains occluded as long as the pressure on the outside of the conduit is equal to or greater than the pressure on the inside of the conduit. When the fluid inlet supply pressure exceeds the pressure acting on the exterior of the conduit, the occlusive segment will inflate and fill with fluid and the pump will force the fluid through the outlet of the conduit. Such a pump is described in more detail in U.S. Pat. No. 5,486,099, which is herein incorporated by reference.

There is an ongoing debate over pulsatile versus non-pulsatile circulatory support. Various published studies, however, have substantiated some advantages with pulsatile support, especially, as it relates to cardiopulmonary support. These studies indicate that pulsatile support reduces systemic vascular resistance and attenuates the catecholamine response; improves myocardial blood flow, and improves overall clinical outcomes. Cerebral pressure-flow auto-regulation has been proven to be intact in adult patients when the mean arterial pressures (MAPS) were greater than 50 mmHg. However, for pediatric patients, where MAP often ranges between 20 to 40 mmHg before and after deep hypothermic cardiac arrest, pulsatile perfusion becomes important for maintaining cerebral blood flow.

Conventional roller pumps can be used to create pulsatile flow and pressure by rapidly accelerating the speed, revolutions per minute (RPM), of the rotor for a "systolic" period and reducing the speed (RPM) to create a "diastolic" period. This has significant disadvantages as it involves use of much greater power to accelerate the rotating mass, increases tubing wear, and increases blood exposure to damaging negative pressures. With this technique it is not possible to isolate the inlet conditions from the outlet conditions. Additionally, the inlet conditions vary as the speed (RPM) is modulated.

In view of the above limitations and drawbacks of the known technology, it is seen that there is a need for a ventricular roller pump that provides pulsatile pressure and flow profiles having amplitudes and rise times that approximate those of a human heart, while maintaining a constant speed (RPM).

BRIEF SUMMARY OF THE INVENTION

In meeting the above need, the present invention provides a roller pump conduit, defining a pump chamber, that includes a roller contact portion having a fill region and a delivery region, the fill region having a first taper and being configured to determine volume delivery per revolution of a roller head. The delivery region has a pressure region having a second taper and a discharge region having a third taper. The second taper has a greater degree of taper than the third taper. The delivery region is configured to produce a pulsatile flow out of the conduit.

In another aspect, a roller pump for pumping fluids is provided that comprises a plurality of rollers located in spaced apart relation. The rollers are attached to a rotor having a drive shaft. A flexible conduit is in mechanical communication with a plurality of rollers. The flexible conduit comprises a roller contact portion having a fill region and a delivery region, the fill region having a first taper. The fill region is configured to determine volume delivery per revolution of a roller head. The delivery region has a pressure region having a second taper and a discharge region having a third taper. The second taper has a greater degree of taper than the third taper. The delivery region is configured to produce a pulsatile flow out of the conduit.

These and other aspects and advantages of the present invention will become apparent upon reading the following detailed description of the invention in combination with the accompanying drawings.

These and other aspects and advantages of the present invention will become apparent upon reading the following detailed description of the invention in combination with the accompanying drawings.

DETAILED DESCRIPTION OF THE INVENTION

The following description is merely exemplary in nature and is in no way intended to limit the invention, its application, or uses.

According to the present invention, a pulsatile rotary ventricular pump (PRVP) is provided as a significant advancement of pump technology, one also capable of addressing performance requirements unique to pediatric surgery. In particular, the innovative advances of the present invention in the chamber design create a pulsatile flow profile (see FIG. 4) that it is anticipated will assist in recovery from deep hypothermic cardiac arrest, a common surgical technique in pediatric patients. The present invention is capable of creating pressure and flow profiles that approximate the pressure and flow profiles created by a human heart. Also, the chamber design and the specification of roller contact on the chamber will allow very fine control at low flows, which is critical in cerebral perfusion of neonates and which cannot be safely delivered by previous roller pumps.

The PRVP will be significantly smaller than an adult pump. These and other features will close the gap between desired levels of performance and that provided by current pediatric arterial pumping technology, as noted in the table below.

| Adult pump (Affinity ®/MetaPlus ®) | PRVP |
|---|---|
| >50 mmHg inlet required for full flow | 10 mmHg required for full flow |
| Min flow accuracy +/− 20 ml/min | Min flow accuracy +/− 2 ml/min |

-continued

| Adult pump (Affinity ®/MetaPlus ®) | PRVP |
|---|---|
| Chamber rated for 6 hours | Durable chamber rated for 1 week |

The invention detailed herein is a cost effective innovation for arterial pumping, particularly to pediatric heart surgery, including physiologic pulsatile flow, very low volume extracorporeal fluid management, ultra fine resolution low flow control, and inherent safety to protect against operator error.

Figure 1A:
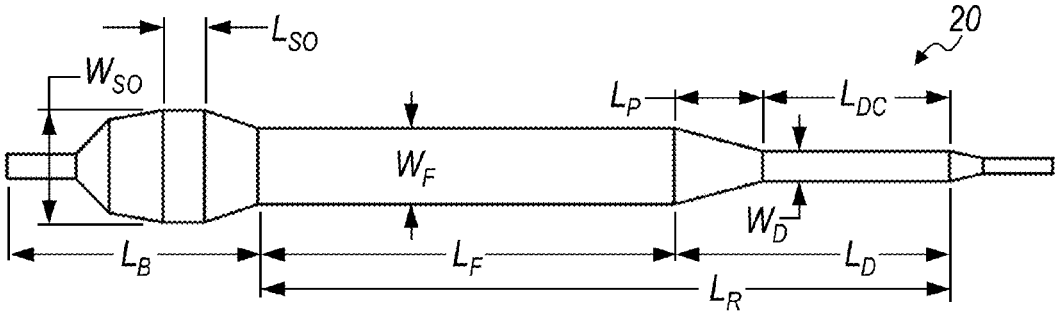
FIG. 1*a* is a side view of a roller pump conduit having a reduction in the cross sectional area within the delivery region of the conduit.
Figure 1B:
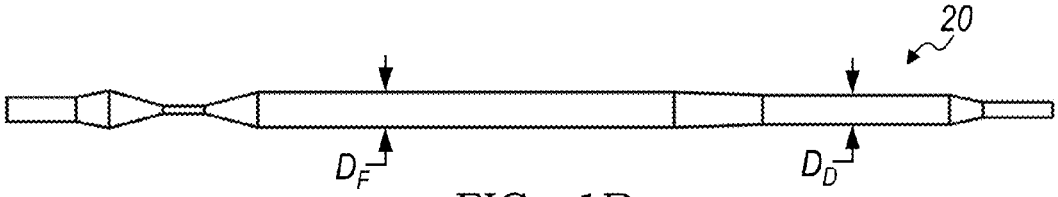
FIG. 1*b* is a plan view of the roller pump conduit of FIG. 1*a;*

The pulsatile rotary ventricular pump (PRVP) of the present invention includes a flexible conduit 20 defining a pump chamber. The pump chamber includes specific regions, as shown in FIGS. 1*a* and 1*b*, which show the flexible conduit 20 in a side view and a plan view, respectively. These regions include the bias region $L_B$, the low volume shut-off region $L_{SO}$, the roller contact region $L_R$, the fill region $L_F$, the delivery region $L_D$, the pressure region $L_P$, and the discharge region $L_{DC}$. Each region is designed to impart specific performance characteristics to the pump chamber. The exact dimensional parameters of each region can be adjusted to optimize the performance to the application.

The bias region $L_B$ receives fluid into the flexible conduit from a venous reservoir and provides for low pressure head passive filling. The bias region $L_B$ includes the low volume shut-off region $L_{SO}$, which stops the flow of fluid into the fill region $L_F$ when the shut-off region $L_{SO}$ is compressed. The shut-off region Lso provides low suction head shut-off for management of very low reservoir volumes.

A roller contact region $L_R$ includes both the fill region $L_F$ and the delivery region $L_D$. Each roller 24 contacts the fill region $L_F$, and advances along the flexible conduit 20 through the fill region $L_F$ and into the delivery region $L_D$.

The fill region $L_F$ is connected to the bias region $L_B$. The fill region $L_F$ determines volume delivery per revolution of pump head, or maximum flow rate. In other words, the fill region $L_F$ of the pump chamber determines the "stroke volume" or the amount of blood delivered per roller pass. The width, depth and wall thickness of the fill region $L_F$ are such that they optimize filling under low pressure head conditions. The fill region $L_F$ has a taper, but that taper may have a magnitude or degree of taper equal to zero. The fill region $L_F$ of FIGS. 1*a* and 1*b* has a constant width, and therefore, a taper of zero magnitude or degree.

The delivery region $L_D$ includes a pressure region $L_P$ and a discharge region $L_{DC}$. The pressure region $L_P$ is characterized by a tapering cross sectional area which results in pressurization of the advancing fluid. The tapering cross section of the pressure region $L_P$ couples the larger-width fill region $L_F$ to the smaller-width discharge region $L_{DC}$ of the delivery region $L_D$. The discharge region $L_{DC}$ of the delivery region $L_D$ has a taper, but that taper may have a magnitude or degree of taper equal to zero. The discharge region $L_{DC}$ has a taper of lesser degree than the taper of the pressure region $L_P$. The discharge region $L_{DC}$ of FIGS. 1*a* and 1*b* has a constant width, and therefore, a taper of zero magnitude or degree. The amount of pressure developed is controlled by the total volume of the delivery region $L_D$, as determined by the degree, or magnitude, and length of the taper of the pressure region $L_P$ and the position of the taper of the pressure region $L_P$ along the length of the flexible conduit 20.

The pressure region $L_P$ provides augmented volume delivery for the "systolic" portion of pulsatile flow. The remainder of the delivery region $L_D$, the discharge region $L_{DC}$, provides the "diastolic" portion of pulsatile flow and fine flow resolution at low speeds (RPM). The resulting flow and pressure are pulsatile and periodic with each roller pass.

Figure 2:
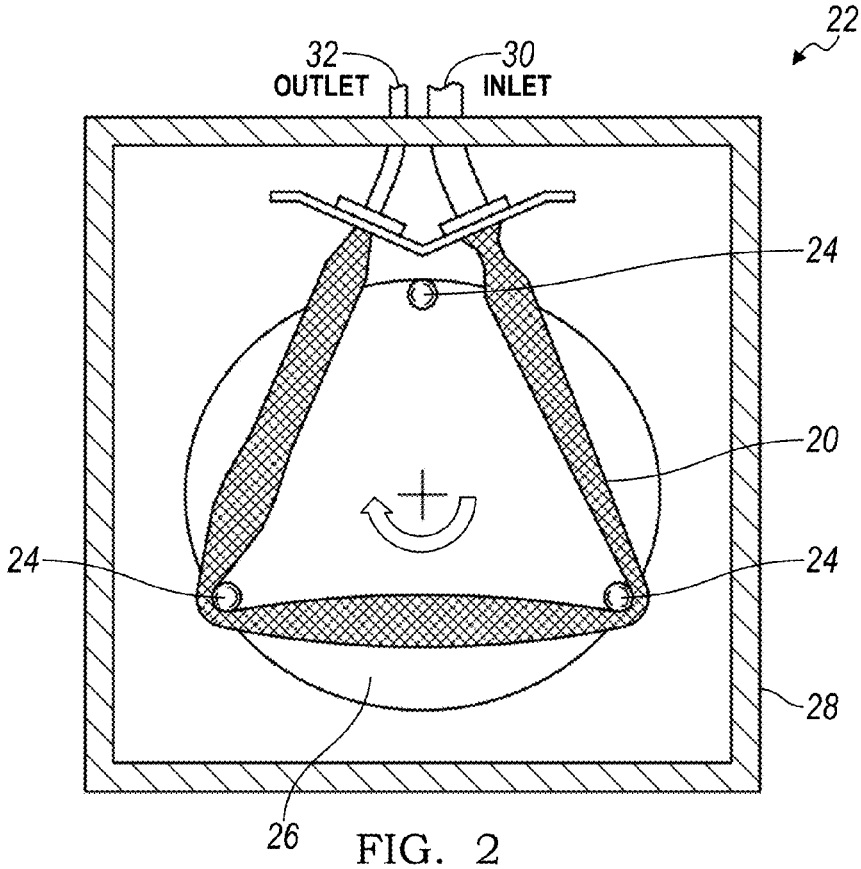
FIG. 2 is a plan view of a roller pump having a flexible conduit as in FIGS. 1*a* and 1*b;*

With reference to FIG. 2, portion of a roller pump 22 is provided. The flexible conduit 20 of FIGS. 1*a* and 1*b* is wrapped around a plurality of freely rotating rollers 24 mounted to a rotor 26, or roller head, of the roller pump 22. The rollers 24 are located in spaced apart relation. The flexible conduit 20 contacts at least two rollers 24 at a time when the roller pump 22 is in operation. The roller pump 22 of FIG. 1 has an enclosure 28, which serves as a protective shield around the moving rotor 26.

When the roller pump 22 is in operation, fluid flows into the inlet 30 of the flexible conduit 20 from a venous reservoir (not shown). As the rollers 24 advance across the flexible conduit 20, fluid is occluded in the fill region $L_F$ of the flexible conduit 20 between two rollers 24. As the rollers 24 advance further along the flexible conduit 20, the isolated fluid shuttles from the fill region $L_F$ to the pressure region $L_P$, which has a tapering cross section, and further into the discharge region $L_{DC}$, which has a reduced, constant cross section, its degree of taper being equal to about zero. Alternatively, the taper of the discharge region $L_{DC}$ could be of a magnitude, or degree, not equal to zero. As the rollers 24 advance along the flexible conduit 20 through the fill region $L_F$ and into the delivery region $L_D$, the captured fluid remains isolated between the rollers 24. This causes the fluid to pressurize within the flexible conduit 20 between the rollers 24. Ideally the isolated fluid is brought to the same pressure or higher pressure than the fluid located in a portion of the flexible conduit 20 that is not isolated.

In the delivery region $L_D$, the roller 24 on the leading edge of the isolated fluid finally advances away from the flexible conduit 20, and the previously isolated fluid is exposed to the outlet 32. An initial pressurized discharge of fluid from the outlet 32 into the extracorporeal circuit (ECC) (not shown) occurs, followed by a reduced period of steady flow as the roller 24 passes over the discharge region $L_{DC}$ of the flexible conduit 20. This causes the flow rate and pressure to be initially higher, followed by a relatively lower pressure and flow rate. As a result, a periodic pulsatile flow and pressure that is of significant amplitude and rise is created, which more closely represent physiologic conditions than non-pulsatile flow and pressure profiles, although the rotor 26 turns at a constant rate.

Design parameters of the roller contact region $L_R$ and the delivery region $L_D$ can be varied until the desired pulsatility is achieved. An "energy equivalent pressure" (EEP) is used to quantify pulsatile pressure and flow waveforms. EEP is the ratio of the area under the hemodynamic power curve and the flow curve at the end of the flow and pressure cycles. The following formula is used for defining EEP:

$$EEP = \frac{\int Q \cdot P dt}{\int Q dt}$$

where Q is the pump flow and P is the arterial pressure. The units for EEP are units of pressure, such as mmHg.

During pulsatile perfusion, EEP is always higher than the mean arterial pressure (MAP), whereas during non-pulsatile flow, EEP is very similar to the MAP. Existing research has shown that pulsatile flow generated higher hemodynamic energy compared with non-pulsatile flow. By way of example, the human heart has been reported to have a 10% increase in EEP, whereas pulsatile roller pumps have previously had approximately a 4% increase in the EEP over the MAP. Non-pulsatile pumps, on the other hand, only have an increase of about 1%. The PRVP according to the present invention can readily reach 10% and, higher increase in EEP.

In order to achieve the desired pulsatility specifications, the pump chamber design of the flexible conduit 20 can be modified to increase the stroke volume of the roller pump 22. Parameters that can be varied include the width and thickness of the roller contact region $L_R$ and the width and thickness of the delivery region $L_D$. If the pulse is too low, then the fill volume can be increased and/or the discharge volume can be decreased. If the pulse is too high, then a reduction in fill volume can be made or a change in the pressure region $L_P$ taper can be made.

Figure 3:
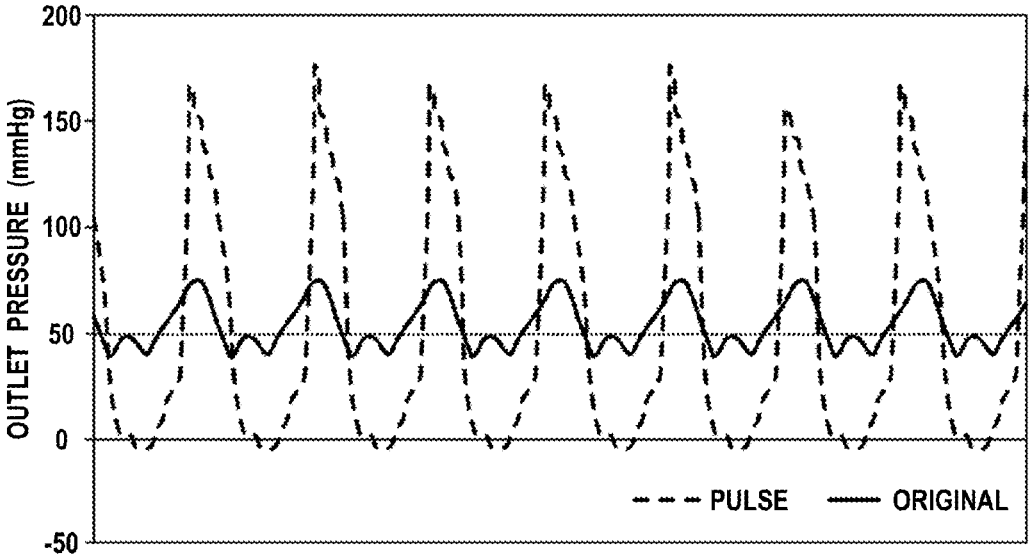
FIG. 3 is a graph of the outlet pressure of a roller pump having the conduit of FIGS. 1*a* and 1*b*, compared with the outlet pressure of a roller pump having a conduit without a reduction in the cross sectional area within the delivery region of the conduit.
Figure 4:
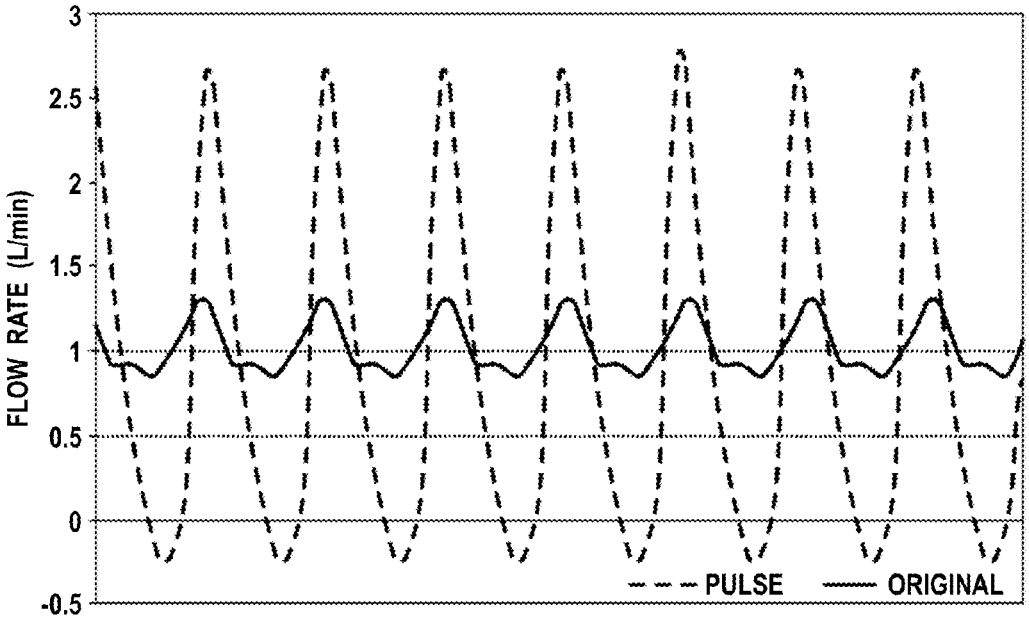
FIG. 4 is a graph of the flow rate of a roller pump having the conduit of FIGS. 1*a* and 1*b*, compared with the outlet pressure of a roller pump having a conduit without a reduction in the cross sectional area within the delivery region of the conduit.

FIGS. 3 and 4 respectively illustrate an outlet pressure/time graph and a flow rate/time graph. In both the outlet pressure graph (FIG. 3) and the flow rate graph (FIG. 4), a prior art style pump chamber, without a pressure build region $L_P$ and without a reduction in the degree of the taper within the delivery region $L_D$, is designated as "Original". A PRVP style pump chamber embodying the principles of the present invention and as generally illustrated in FIGS. 1*a* and 1*b*, and 2, i.e. a conduit having a pressure build region $L_P$ and a reduction in the degree of taper within the delivery region $L_D$, is designated as "Pulse" in the graphs. In both instances, the traces were recorded under identical operation conditions using a 4 inch diameter pediatric-sized rotor 26 having three rollers 24 and operating at an average outlet pressure of 50 mmHg, with an average flow rate of 1 liter/min, and water at room temperature as the pumped medium.

As is readily apparent from the graphs, the "Pulse" trace exhibits a pronounced increase in pulse pressure (FIG. 3) including rise time and amplitude, and a similarly steep rise in flow rate (FIG. 4) and pulsatile flow amplitude, when compared to the "Original" trace.

In contrast to the techniques required to create pulsatile flow with prior technologies, the present invention achieves pulsatile flow using a constant speed rotor 26, and, therefore, can implement pulsatile conditions at the outlet 32, all without affecting inlet conditions and without creating pulsatility at the inlet 30. This has advantages in avoiding low pressure at the inlet, keeping the speed of the rotor 26 low, avoiding excessive wear of the flexible conduit 20, and avoiding damage to the blood pumped through the flexible conduit 20.

The flexible conduit 20 is made from polyurethane or another suitable flexible material. In order to reduce wear on the flexible conduit 20, the flexible conduit 20 is manufactured by injection molding. By injection molding the pump chamber, a durable disposable flexible conduit 20 is produced that can be used for prolonged support after surgery, without the need for changing pumps.

The foregoing disclosure is the best mode contemplated by the inventor for practicing this invention. It is apparent, however, that methods incorporating modifications and variations will be obvious to one skilled in the art. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

We claim:

1. A roller pump conduit defining a pump chamber comprising:

a roller contact portion comprising:

a fill region configured to determine volume delivery per revolution of a roller head and having a substantially constant first width; and a delivery region configured to produce a pulsatile flow out of the conduit in a configuration wherein no portion of the roller contact portion contacts a raceway and comprising: a discharge region having a substantially constant second width less than the first width; and a pressure region that couples the fill region to the discharge region.

2. The roller pump conduit of claim 1, wherein the pressure region includes a taper.

3. The roller pump conduit of claim 1, wherein the pressure region is configured to produce a systolic portion of the pulsatile flow, in a configuration wherein the roller pump conduit is fluidly coupled to a patient.

4. The roller pump conduit of claim 1, wherein the discharge region is configured to produce a diastolic portion of the pulsatile flow, in a configuration wherein the roller pump conduit is fluidly coupled to a patient.

5. The roller pump conduit of claim 1, further comprising a bias region configured to receive fluid into the conduit.

6. The roller pump conduit of claim 5, wherein the bias region comprises a low volume shut-off region, configured to stop the flow of fluid into the fill region when the shut-off region is compressed.

7. The roller pump conduit of claim 1, wherein the thickness of the roller contact portion is varied.

8. The roller pump conduit of claim 1, wherein a thickness of the delivery region is varied, thereby increasing an energy equivalent pressure of the pulsatile flow to at least 10% over a mean arterial pressure of a patient, in a configuration wherein the roller pump conduit is fluidly coupled to the patient.

9. A roller pump for pumping fluids, comprising:

a plurality of rollers coupled to and distributed around a rotor having a drive shaft;

a flexible conduit in contact with at least a portion of the plurality of rollers, comprising:

a roller contact portion comprising:

a fill region configured to determine volume delivery per revolution of a roller head and having a substantially constant first width; and a delivery region configured to produce a pulsatile flow out of the conduit and comprising:

a discharge region having a substantially constant second width less than the first width; and a pressure region that couples the fill region to the discharge region, wherein a thickness of the roller contact portion is varied.

10. The roller pump of claim 9, wherein the pressure region includes a taper.

11. The roller pump of claim 9, wherein the pressure region is configured to produce a systolic portion of the pulsatile flow and the discharge region is configured to produce a diastolic portion of the pulsatile flow, in a configuration wherein the roller pump conduit is fluidly coupled to a patient.

12. The roller pump of claim 9, wherein the rotor is configured to rotate at a substantially constant rate.

13. The roller pump of claim 9, further comprising a bias region configured to receive fluid into the conduit, wherein the bias region comprises a low volume shut-off region, configured to stop the flow of fluid into the fill region when the shut-off region is compressed.

14. The roller pump of claim 9, wherein the conduit is injection molded.

15. The roller pump of claim 9, wherein the conduit is configured to maintain contact with at least two of the plurality of rollers.

16. The roller pump of claim 9, wherein a thickness of the delivery region is varied, thereby increasing an energy equivalent pressure of the pulsatile flow to at least 10% over a mean arterial pressure of a patient, in a configuration wherein the roller pump conduit is fluidly coupled to the patient.

17. A roller pump for pumping fluids, comprising:

a plurality of rollers coupled to and distributed around a rotor having a drive shaft;

a flexible conduit in contact with at least a portion of the plurality of rollers, comprising:

a roller contact portion comprising:

a fill region configured to determine volume delivery per revolution of a roller head and having a first taper; and a delivery region configured to produce a pulsatile flow out of the conduit and comprising:

a pressure region configured to produce a systolic portion of the pulsatile flow and a discharge region configured to produce a diastolic portion of the pulsatile flow, in a configuration wherein the roller pump conduit is fluidly coupled to a patient, wherein a thickness of the roller contact portion is varied.

18. The roller pump of claim 17, wherein the pressure region includes a second taper.

19. The roller pump of claim 18, wherein the discharge region includes a third taper having a lesser degree of taper than the second taper.

20. The roller pump of claim 19, wherein the degree of taper of at least one of the first taper and of the third taper is equal to approximately zero.

21. The roller pump of claim 17, wherein the rotor is configured to rotate at a substantially constant rate.

22. The roller pump of claim 17, further comprising a bias region configured to receive fluid into the conduit, wherein the bias region comprises a low volume shut-off region, configured to stop the flow of fluid into the fill region when the shut-off region is compressed.

23. The roller pump of claim 17, wherein the conduit is in contact with at least two of the plurality of rollers.

24. The roller pump of claim 17, wherein the conduit is injection molded.

25. The roller pump of claim 17, wherein a thickness of the delivery region is varied, thereby increasing an energy equivalent pressure of the pulsatile flow to at least 10% over a mean arterial pressure of a patient, in a configuration wherein the roller pump conduit is fluidly coupled to the patient.

* * * * *